US009181728B2

(12) United States Patent
Farag et al.

(10) Patent No.: US 9,181,728 B2
(45) Date of Patent: Nov. 10, 2015

(54) PICK-RESISTANT LOCK CYLINDER USING TORQUE RESISTANCE

(71) Applicant: KWIKSET CORPORATION, Lake Forest, CA (US)

(72) Inventors: Hanna O. Farag, Riverside, CA (US); John C. Charnley, Newcastle Upon Tyne (GB); Mark S. Bloom, Lake Forest, CA (US); Clinton E. Sheppard, Mountain Home, AR (US)

(73) Assignee: Kwikset Corporation, Lake Forest, CA (US)

( * ) Notice: Subject to any disclaimer, the term of this patent is extended or adjusted under 35 U.S.C. 154(b) by 0 days.

(21) Appl. No.: 14/096,162

(22) Filed: Dec. 4, 2013

(65) Prior Publication Data

US 2014/0150506 A1 Jun. 5, 2014

Related U.S. Application Data

(60) Provisional application No. 61/733,000, filed on Dec. 4, 2012.

(51) Int. Cl.
*E05B 27/00* (2006.01)
*E05B 9/08* (2006.01)
(Continued)

(52) U.S. Cl.
CPC ..... *E05B 27/0071* (2013.01); *E05B 9/086* (2013.01); *E05B 15/006* (2013.01);
(Continued)

(58) Field of Classification Search
CPC ..... E05B 27/0017; E05B 27/0057; E05B 27/006; E05B 15/006; E05B 17/0041; E05B 27/0071
USPC ..... 70/493, 386, 375, 367, 416, 419
See application file for complete search history.

(56) References Cited

U.S. PATENT DOCUMENTS 2,043,205 A * 6/1936 Thompson ..... 70/419
2,059,129 A * 10/1936 Maxwell et al. ..... 70/493
(Continued)

FOREIGN PATENT DOCUMENTS

DE 628 600 C 4/1936
DE 202 08 399 U 1 8/2002
(Continued)

OTHER PUBLICATIONS

International Search Report; Patent Cooperation Treaty; Apr. 1, 2014.

*Primary Examiner* — Suzanne Barrett
(74) *Attorney, Agent, or Firm* — Barnes & Thornburg LLP

(57) ABSTRACT

A torque augmentor operatively associated with the cylinder assembly and the plug assembly of a pin tumbler lock cylinder increases the threshold torque required to rotate the plug assembly in the cylinder assembly, thereby hampering an attacker's "feel" for the relationship of the cylinder pins to the shear line, and of the plug assembly to the cylinder. One embodiment of the pick-resistant lock cylinder includes a spring-biased ball normally disposed across the shear line. Another embodiment has a cam normally biased into engagement with a cam follower, the cam being disposed on one of the cylinder assembly and the plug assembly, and the cam follower being disposed on the other. Another embodiment includes an hourglass-shaped false shear line creator operatively associated with the cylinder assembly and plug assembly. The coaction of the torque augmentor and false shear line creator of the lock cylinder of the present invention also hampers an attack by bumping.

12 Claims, 12 Drawing Sheets

(51) Int. Cl.
*E05B 15/00* (2006.01)
*E05B 15/04* (2006.01)

(52) U.S. Cl.
CPC ..... *E05B27/006* (2013.01); *E05B 27/0057* (2013.01); *E05B 2015/0066* (2013.01); *E05B 2015/0462* (2013.01); *Y10T 70/7605* (2015.04)

(56) References Cited

U.S. PATENT DOCUMENTS

| | | | | | |
|---|---|---|---|---|---|
| 2,149,733 | A | * | 3/1939 | Hagendorn et al. | 70/493 |
| 2,202,329 | A | * | 5/1940 | Sholom | 70/419 |
| 2,283,489 | A | * | 5/1942 | Crousore | 70/419 |
| 3,587,081 | A | * | 6/1971 | Hawkins et al. | 340/529 |
| 3,762,193 | A | * | 10/1973 | Hucknall | 70/419 |
| 3,837,194 | A | * | 9/1974 | Fish | 70/276 |
| 4,631,941 | A | * | 12/1986 | Sjunnesson | 70/337 |
| 5,247,818 | A | * | 9/1993 | Lo | 70/493 |
| 5,964,111 | A | | 10/1999 | Lambert | |
| 6,170,307 | B1 | | 1/2001 | Feder | |
| 6,675,617 | B2 | * | 1/2004 | Stemmerik | 70/493 |
| 6,758,074 | B1 | * | 7/2004 | Prunbauer | 70/366 |
| 7,086,259 | B2 | * | 8/2006 | Almoznino | 70/359 |
| 7,100,409 | B2 | * | 9/2006 | Chang | 70/493 |
| 8,166,783 | B2 | * | 5/2012 | Burmesch et al. | 70/493 |
| 8,438,889 | B2 | * | 5/2013 | Eller et al. | 70/493 |
| 8,739,588 | B2 | * | 6/2014 | Burmesch et al. | 70/493 |
| 2008/0202180 | A1 | * | 8/2008 | Eller et al. | 70/493 |
| 2009/0056396 | A1 | * | 3/2009 | Liu | 70/493 |
| 2009/0107195 | A1 | * | 4/2009 | Gallian | 70/493 |
| 2010/0212383 | A1 | * | 8/2010 | Stuart | 70/493 |
| 2011/0214462 | A1 | * | 9/2011 | Loughlin et al. | 70/493 |
| 2014/0150506 | A1 | * | 6/2014 | Farag et al. | 70/493 |

FOREIGN PATENT DOCUMENTS

| | | | | | |
|---|---|---|---|---|---|
| EP | 1464778 | A2 | * | 10/2004 | E05B 27/04 |
| JP | 2005 290909 | A | | 10/2005 | |
| WO | WO 8303869 | A1 | * | 11/1983 | E05B 27/00 |
| WO | WO 2008050464 | A1 | * | 5/2008 | E05B 27/00 |
| WO | WO 2009/037729 | A1 | | 3/2009 | |
| WO | WO 2011/074939 | A2 | | 6/2011 | |

* cited by examiner

PICK-RESISTANT LOCK CYLINDER USING TORQUE RESISTANCE

RELATED APPLICATIONS

This application is related to and claims priority to U.S. Provisional Patent Application Ser. No. 61/733,000, filed on Dec. 4, 2012, entitled "Pick-Resistant Lock Cylinder Using Torque Resistance." The subject matter disclosed in that provisional application is hereby expressly incorporated into the present application in its entirety.

TECHNICAL FIELD

The present invention relates generally to pin tumbler lock cylinders that are resistant to picking and bumping attacks. More particularly, the present invention relates to a pin tumbler lock cylinder that employs torque resistance to hamper the ability of an attacker to open the lock using picking or bumping.

BACKGROUND

Pin tumbler lock cylinders, generally speaking, are susceptible to attacks by picking or bumping. In a picking attack, a first tool or torque wrench is inserted into the plug assembly keyway and a small threshold rotational torque is applied and held. A second tool or pick is inserted in the keyway and manipulated to successively move the key followers and associated cylinder pins so that the cylinder pins rise above the shear line between the cylinder body and plug assembly. The torque on the plug assembly will cause a slight misalignment of the respective key follower and cylinder pin bores, which will prevent the cylinder pins from falling back down across the shear line. During this process, the attacker must sense by feel the cylinder pin rising above the shear line and the amount the plug rotates, and apply greater or lesser torque to keep the "set" of the picked pins while feeling for the next pin's relationship to the shear line. In a bumping attack, the attacker inserts a special "bump" key into the keyway and applies a threshold rotational torque. Then the attacker applies at least one axial blow to the bump key. This shock causes the cylinder pins to jump above the shear line; as the pins rise, they separate as the shock is transferred from the bottom pin to the top pin, and the applied torque will turn the plug assembly before the cylinder pins can be driven back into place by their respective springs. However, too much applied torque will "crush" a cylinder pin at the shear line, which will then absorb the shock of the applied axial blow, and the cylinder pins won't jump. Another form of attack is to "impression" the lock mechanism.

The common denominator in all three types of attacks is applying, maintaining and modulating a rotational torque to the plug assembly and sensing it throughout the process.

One approach to defeating lock picking is by using spool pins, namely pins with an outer cylindrical shape and a smaller, inner cylindrical shape, to create false shear lines so that attackers think they've successfully moved a cylinder pin above the shear line. Unfortunately, the more spool pins are used to replace the cylindrical cylinder pins, the more likely that one or more spool pins will become unstable in the mechanism, and jam the lock, even when a valid key is used to unlock the mechanism.

SUMMARY

One embodiment of the present invention counterattacks that common denominator by increasing both the threshold torque and the torque required to maintain the cylinder pins above the shear line, thereby disrupting the attacker's "feel" for the relationship of the cylinder pins to the shear line, and of the plug assembly to the cylinder assembly. Another embodiment of the present invention creates a false shear line, exacerbating the difficulty of creating and holding the set of cylinder pins above the shear line.

Accordingly, in one aspect, the present invention provides a torque augmentor operatively associated with the cylinder assembly and plug assembly to increase the threshold torque required to rotate the plug assembly in the cylinder assembly, thereby hampering the attacker's ability to sense the relationship of at least one cylinder pin to the shear line, as the attacker manipulates the second tool after having applied a rotational torque with the first tool.

According to another aspect, the present invention increases the torque required for the attacker to hold the set above the shear line while picking the remaining pins.

According to a further aspect, the present invention uses a detent to augment the threshold torque. In some embodiments, the present invention creates the detent by a ball that normally lies across the shear line, the ball being disposed in a bore formed in the cylinder body and spring-biased into a blind bore formed in the plug assembly. In some cases, the present invention creates the detent using a cylinder with a cone-shaped tip that normally lies across the shear line, the cone-shaped tip being disposed in a bore formed in the cylinder body and being spring-biased into a blind bore formed in the plug assembly.

In another aspect, the present invention varies the profile or contour of the detent tip so that a variable amount of torque would be required to overcome the torque resistance. For example, the contours of the detent tips could vary and also the shapes of the false shear line creators could vary to create even more permutations and combinations of required torques that an attacker encounters while trying to feel for torque resistance. In some cases, the torque is augmented by using a cam.

In a still further aspect, the present invention creates a false shear line by using hourglass-shaped cylinder pins that, when straddling the shear line, cause the attacker to falsely sense the presence of a shear line when manipulating the first and second tools. In some cases, a torque augmentor is used to stabilize the false shear line creators so they will not jam the lock mechanism when a valid key is used in the lock.

DESCRIPTION OF THE PREFERRED EMBODIMENTS

Figure 1:
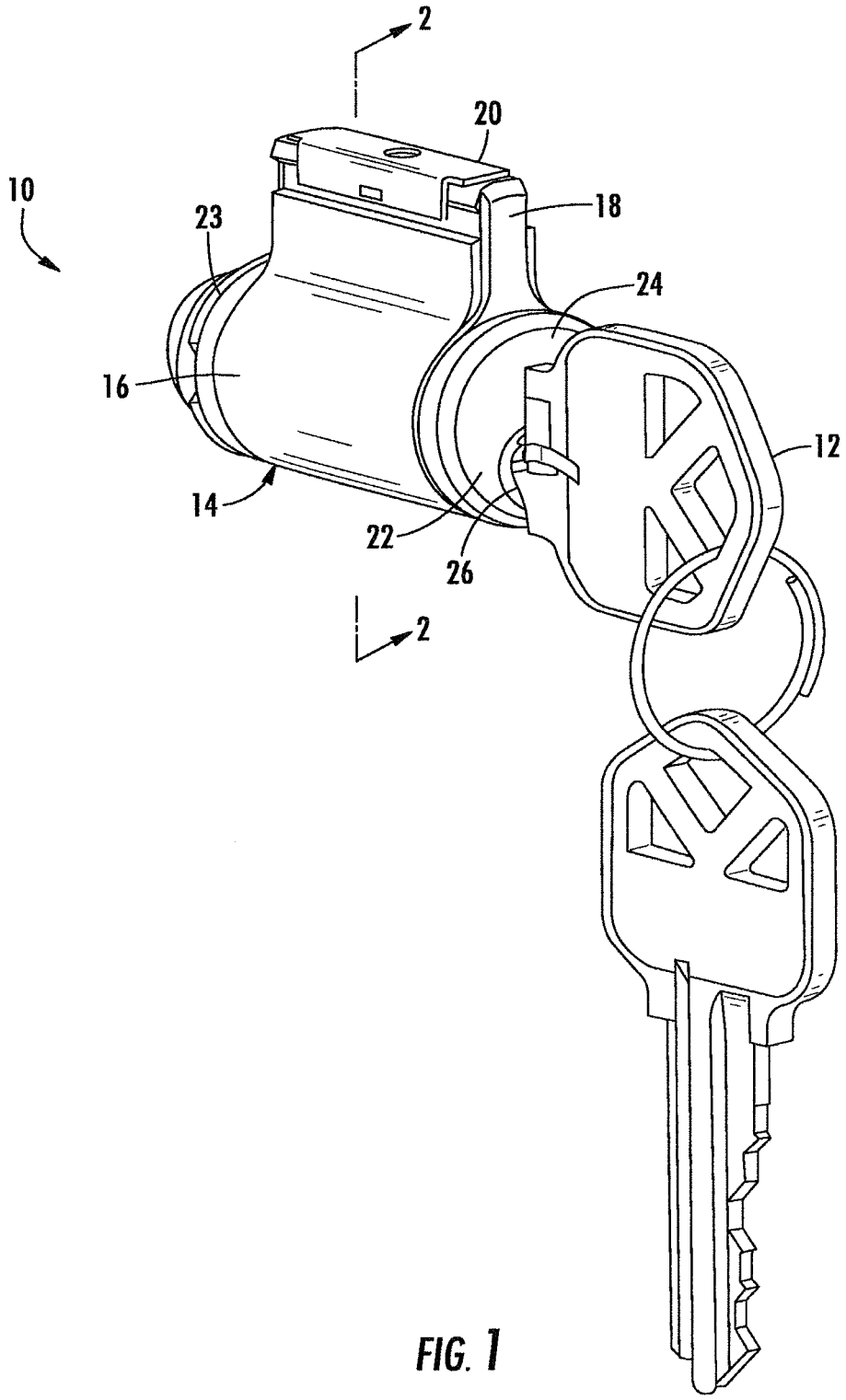
FIG. 1 Prior Art
FIG. 1 is a perspective view of a pin tumbler lock cylinder.
Figure 2:
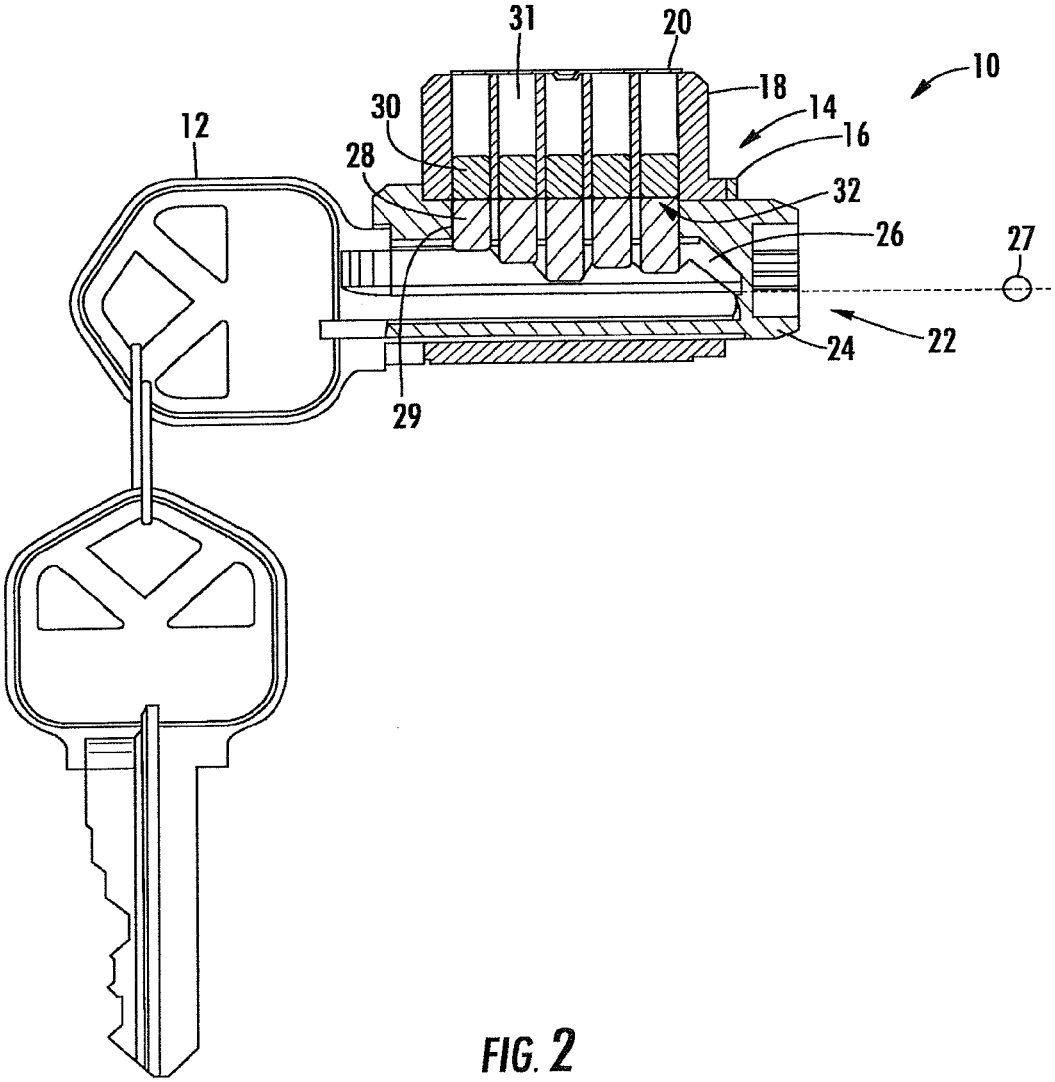
FIG. 2 Prior Art
FIG. 2 is a section view, taken along line 2-2 of FIG. 1, of a pin tumbler lock cylinder with a valid key inserted.
Figure 3:
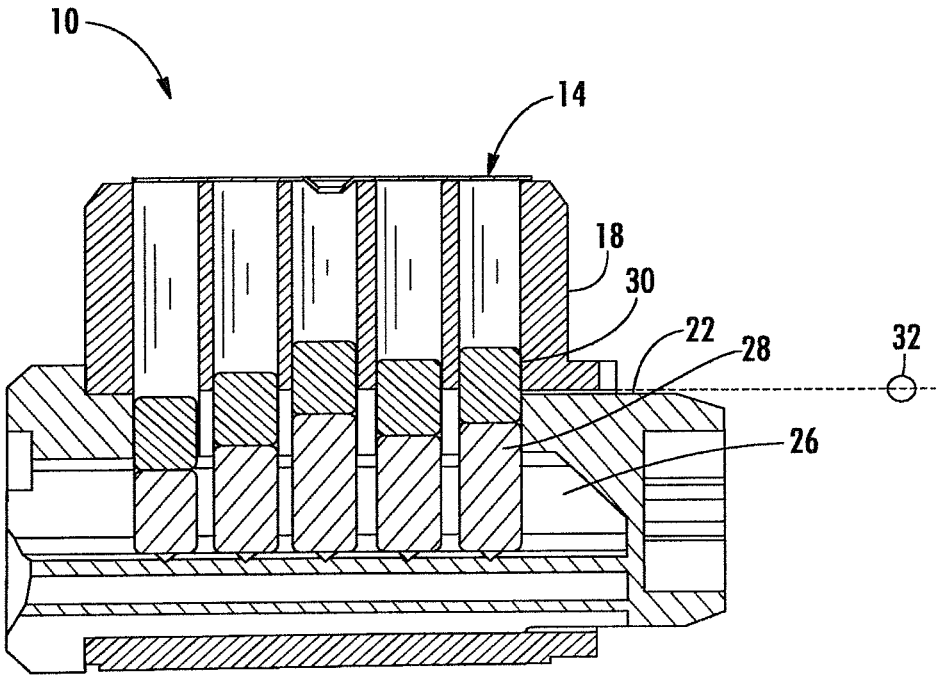
FIG. 3 Prior Art
FIG. 3 is an enlarged sectional detail view of the pin tumbler lock cylinder of FIG. 2 with the key removed.

FIGS. 1 and 2 show a typical pin tumbler lock cylinder 10 with a valid key 12 inserted. The lock cylinder 10 includes a cylinder assembly 14 having a cylinder body 16 with a chimney 18 and a chimney cap 20, and a plug assembly 22 having a plug body 24 defining a keyway 26 and an axis 27, the plug assembly being retained in the cylinder body by a clip 23. When the valid key 12 is inserted, key followers 28 disposed in key follower bores 29 formed in plug body 24 relocate to conform to the cut of the valid key 12, thereby relocating spring-loaded cylinder pins 30 disposed in cylinder pin bores 31 formed in chimney 18. Cylinder pins 30 are normally biased into engagement with the key followers 28 by compression springs (not shown in these Figures) in the cylinder pin bores 31. The cylinder pins 30 are relocated such that a shear line 32 is established at the boundary between plug body 24 and cylinder body 16. This allows plug assembly 22 to rotate within cylinder assembly 14. Now referring to FIG. 3, upon removing valid key 12 from keyway 26, spring-loaded cylinder pins 30 can relocate key followers 28 to a bottom of their travel, thereby blocking or straddling shear line 32. This in turn prevents plug assembly 22 from rotating in cylinder assembly 14, and a door using this lock cylinder 10 will be locked. This is the well-known lock cylinder structure that is far too vulnerable to attacks. Two common attack methods are picking and bumping; picking is illustrated in FIGS. 4-7, and bumping in FIGS. 8, 9A, 9B and 9C.

Figure 4:
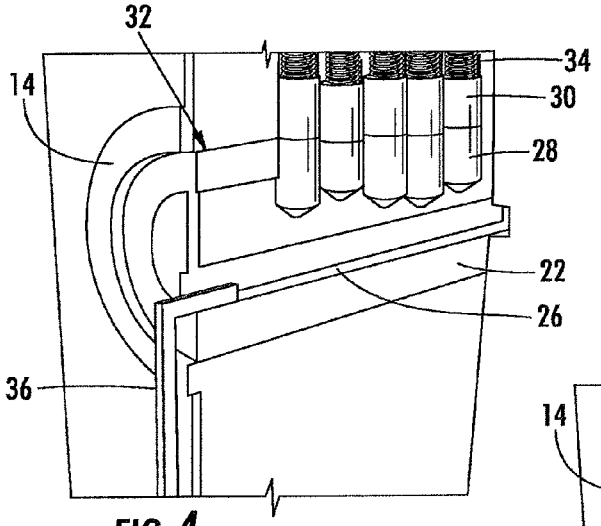
FIG. 4 Prior Art
FIG. 4 is a partial schematic section view of a pin tumbler lock cylinder with a torque wrench inserted in the keyway.
Figure 5:
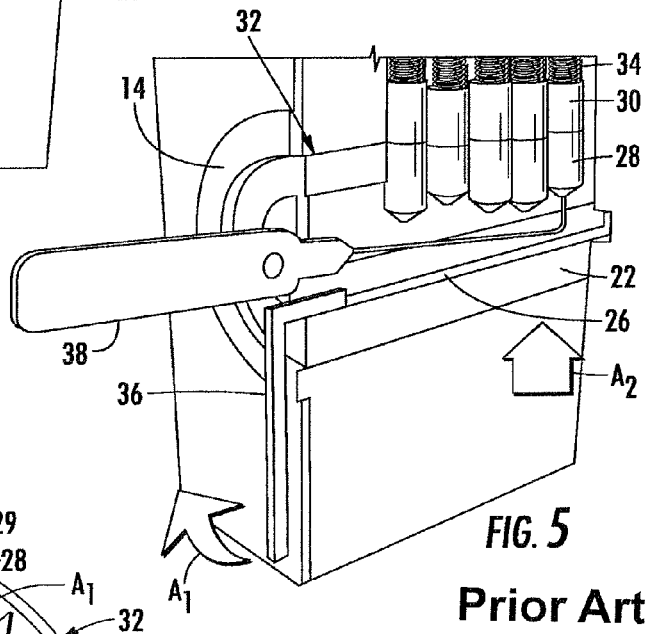
FIG. 5 Prior Art
FIG. 5 is a partial schematic view of the lock cylinder of FIG. 4 with a pick also inserted in the keyway.
Figure 6:
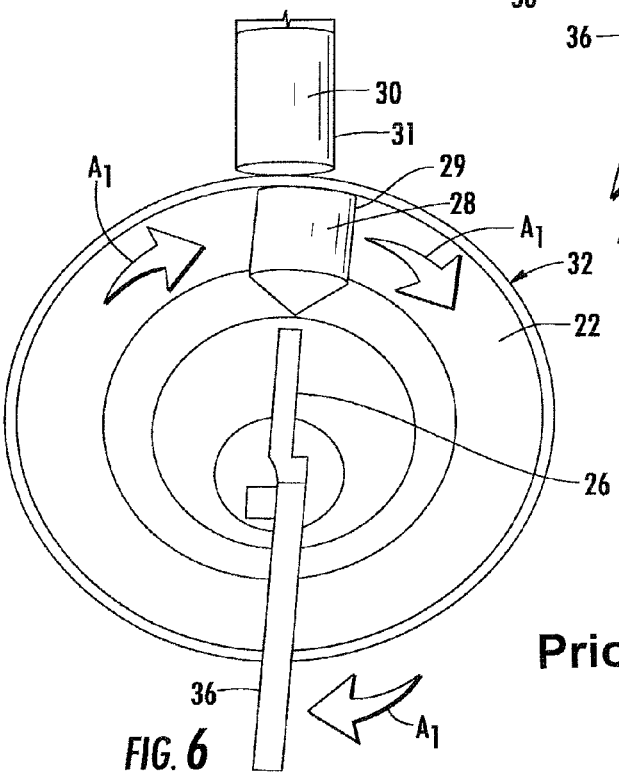
FIG. 6 Prior Art
FIG. 6 is an enlarged schematic detail view of the lock cylinder of FIG. 5 with a cylinder pin set above the shear line.

As shown in FIGS. 4 and 5, to mount an attack using picking, a torque wrench 36 is inserted in the keyway 26 and a light rotational torque is applied in the unlocking direction as, for example, indicated by arrow Ai, in the neighborhood of from 1 to 3 inch-ounce force. This is just enough threshold torque so the attacker can feel the first cylinder pin 30 getting above the shear line 32 when the attacker manipulates a pick 38 inserted in keyway 26, as shown by arrow A2 in FIG. 5. The attacker actually does not feel the cylinder pin 30 directly, but instead presses the end of pick 38 against the bottom of key follower 28 against the bias of spring 34. However, if the attacker applies too much torque with torque wrench 36, it will be difficult to push key follower 28 and cylinder pin 30 up at all. That is because, as shown in FIG. 6, when torque is applied to the plug assembly 22, a slight misalignment exists between the cylinder pin bore 31 and the key follower bore 29. If the right torque is applied, cylinder assembly 14 and plug assembly 22 have just enough play so that the cylinder pin can be pushed up above the shear line 32. Then, when the attacker pulls the pick 38 down a little, the cylinder pin 30 cannot fall back across the shear line 32, because the cylinder pin no longer lines up with the key follower bore 29. However, as just noted, too much torque can freeze the play among the cylinder pin 30, cylinder assembly 14 and plug assembly 22 so the cylinder pin cannot be easily pushed past the misalignment.

Figure 7:
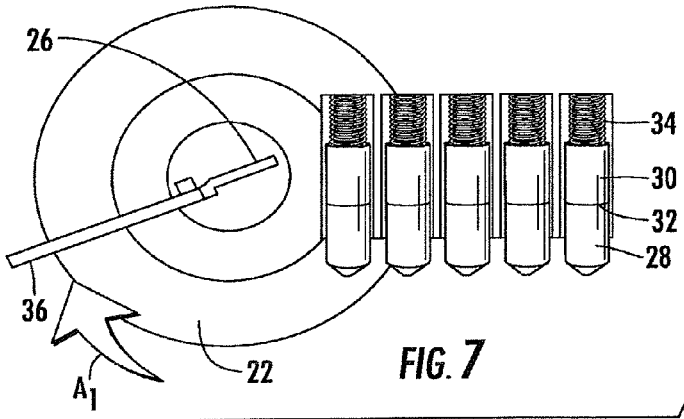
Prior Art FIG. 7
FIG. 7 is an enlarged composite schematic partial sectional view of the lock cylinder of FIG. 6 with all of the cylinder pins set above the shear line, and the torque wrench turning the plug assembly.
Figure 8:
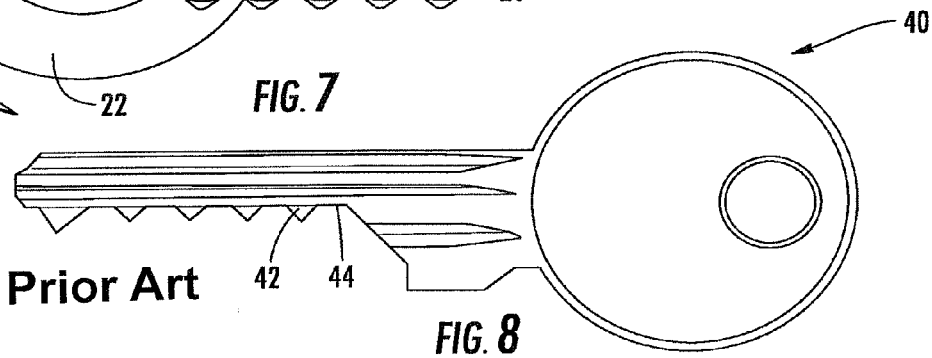
Prior Art FIG. 8
FIG. 8 is a side elevational view of a typical bump key.

Continuing with the pick process, when the attacker successfully moves the cylinder pin 30 above the shear line 32, such that the cylinder pin falls back against the edge of the plug assembly 22, the attacker has achieved a "set" of that cylinder pin. In addition, the attacker can sense an incremental rotation of the plug assembly 22 within the cylinder assembly 14 after the cylinder pin 30 has been moved above the shear line 32. That tells the attacker that a set of that cylinder pin 30 has been achieved. Now it becomes very important for the attacker to keep applying just enough torque on the plug assembly 22 so that the set is maintained while the attacker moves the pick 38 to the next key follower 28. Here, the attacker may need to apply greater or lesser torque to manipulate the second cylinder pin 30, because it is likely that there will be slight differences in geometry from one group of pins 30 and followers 28 to the next, each requiring a different degree of torque. Referring to FIG. 7, all of the cylinder pins 30 have been pushed above the shear line 32 so that the attacker can now rotate the plug assembly 22 in the cylinder assembly 14 with the torque wrench 36, and unlock the door.

Figure 9A:
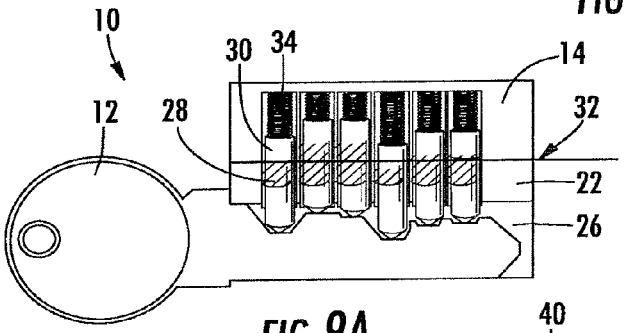
FIG. 9A Prior Art
FIGS. 9A, 9B and 9C are schematic views of a bumping attack against a pin tumbler lock cylinder.
Figure 9B:
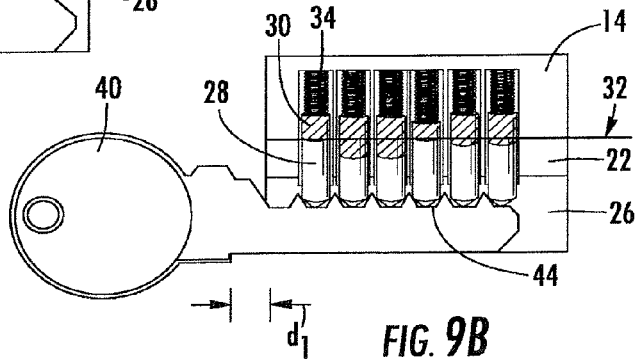
FIG. 9B Prior Art
Figure 9C:
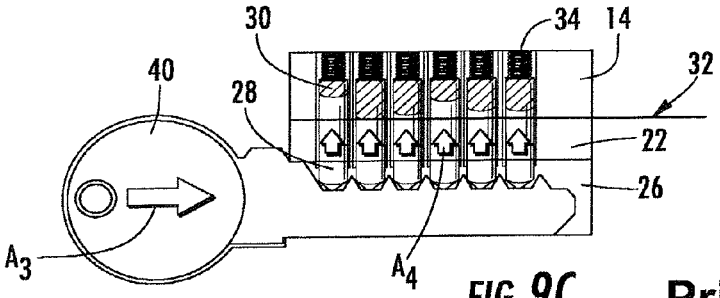
FIG. 9C Prior Art

Bumping is another torque-sensitive method of attacking a pin tumbler lock cylinder. The attacker first starts by using a specially-machined bump key 40, shown in FIG. 8. A bump key 40 uses a key blank of the type that matches a particular manufacturer's lock, but which has been machined to the lowest factory setting or key code for all of the peaks 42 and valleys 42 of the key. Machining all of them at the lowest level guarantees that no matter how long or short the various key followers 28 or cylinder pins 30 may be, the cylinder can turn with the bump key fully inserted. The attacker then follows the sequence shown in FIGS. 9B and 9C. In FIGS. 2 and 9A, as described above, insertion of a valid key 12 into the keyway 26 aligns the key followers 28 and cylinder pins 30 along the shear line 32, and the plug assembly 22 is free to turn. However, during a bumping attack, as shown in FIG. 9B, the attacker inserts a bump key 40 all the way into the keyway 26, but then pulls it back one or more notches or valleys 44, as shown by distance dj. It is also common not to withdraw the bump key 40 at all. The bump key peaks 42 are now ready to abruptly hit the key followers 28 and their corresponding cylinder pins 30, moving them upwardly upon application of an axially-inward blow to the bump key 40. As shown in FIG. 9C, now the attacker applies just the right rotational torque to the plug assembly 22 with the bump key 40, and hits the end of the bump key, as shown by arrow $A_3$. The energy of the blow causes the cylinder pins 30 to jump above shear line 32 and separate from the key followers 28, as shown by arrows $A_4$. Although this separation is brief, the applied torque moves the key follower bores 29 past the cylinder pins 30 before they can fall back into the key follower bores, and the attacker can turn the plug assembly 22. Sometimes more than one blow is required.

Again, fine-tuning applied torque is the key to this attack. Too much torque, and either the cylinder pins 30 won't jump past the shear line 32, or one or more cylinder pins will tilt and can't be moved. Too little torque and the cylinder pins 30 fall back into their home or locked position, and the attacker starts over.

The pick-resistant lock cylinder 50 of the present invention counterattacks the common denominator of both types of attack—the applied torque. It has been discovered that if the lock cylinder presents a torque resistance in the range of from 25 to 35 inch-ounce force, the attacker faces two challenges: First, raising the torque resistance to this level tends to keep the plug assembly in the home position, so that an attacker must use more torque to create a set and has a harder time feeling or sensing the position of the cylinder pins 30 relative to the shear line 32. Second, all of the challenges in sensing or feeling just the right amount of torque to maintain the set of one or more cylinder pins 30, while attempting to manipulate another one, are exacerbated when the torque resistance is increased to this extent. The result is that it takes a much longer time to create and hold a complete set, if at all, and time is something the attacker does not have. Thus, encountering the pick-resistant lock cylinder 50 of the present invention could cause the attacker to move to a house with easier pickings.

Figure 10:
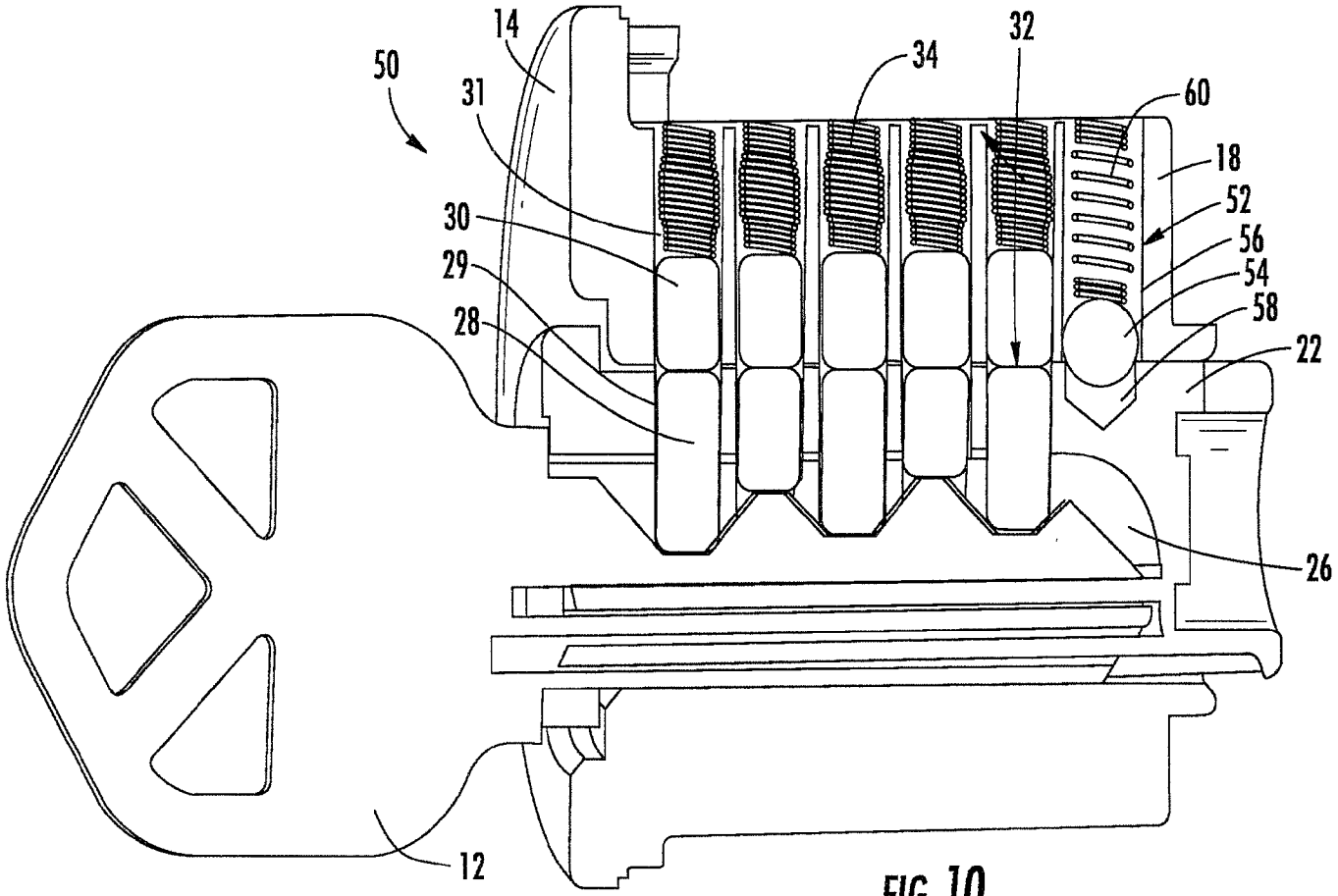
FIG. 10 is a side elevational detail view, partially in section, of one embodiment of a pick-resistant lock cylinder of the present invention with a valid key inserted.

FIG. 10 illustrates one embodiment of a pick-resistant lock cylinder 50 of the present invention. A torque augmenter 52 includes a ball 54 disposed in an augmenter bore 56 formed in the chimney 18 parallel to the cylinder bores 31. The ball 54 is urged into engagement with a blind bore 58 formed in plug assembly 22 by a ball compression spring 60, so that the ball straddles the shear line 32. The dimensions and strength of the ball compression spring 60, and the other parameters of the torque augmenter 52, are selected to yield the desired range of 6 to 18 inch-ounces. This range is high enough to resist lock picking and bumping, but low enough to meet the code requirements for Grades 1, 2 and 3 locks. If desired, the range of torque resistance can be increased to 28 to 30 inch-ounces, but this will presently meet only Grade 3 specifications. The same effect can be achieved by using a cylindrical pin with a cone-shaped or spherical-shaped tip, as well as other geometries, instead of a ball. Furthermore, using detents with varying shapes will vary the torque required by an attacker to overcome the torque resistance. This adds a significant amount of complexity, and therefore time, to the attacker's attempts upon the lock cylinder of the present invention.

Figure 11B:
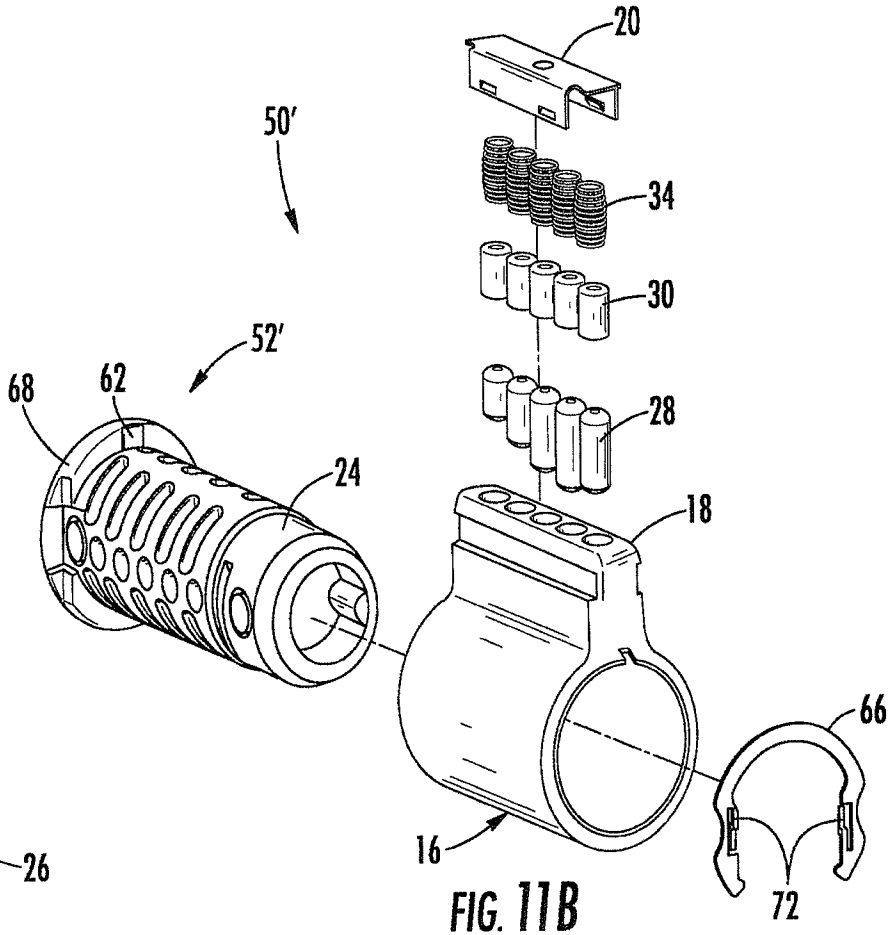
FIGS. 11A and 11B are partial exploded perspective views, taken from opposite directions, of another embodiment of a pick-resistant lock cylinder of the present invention.
Figure 11A:
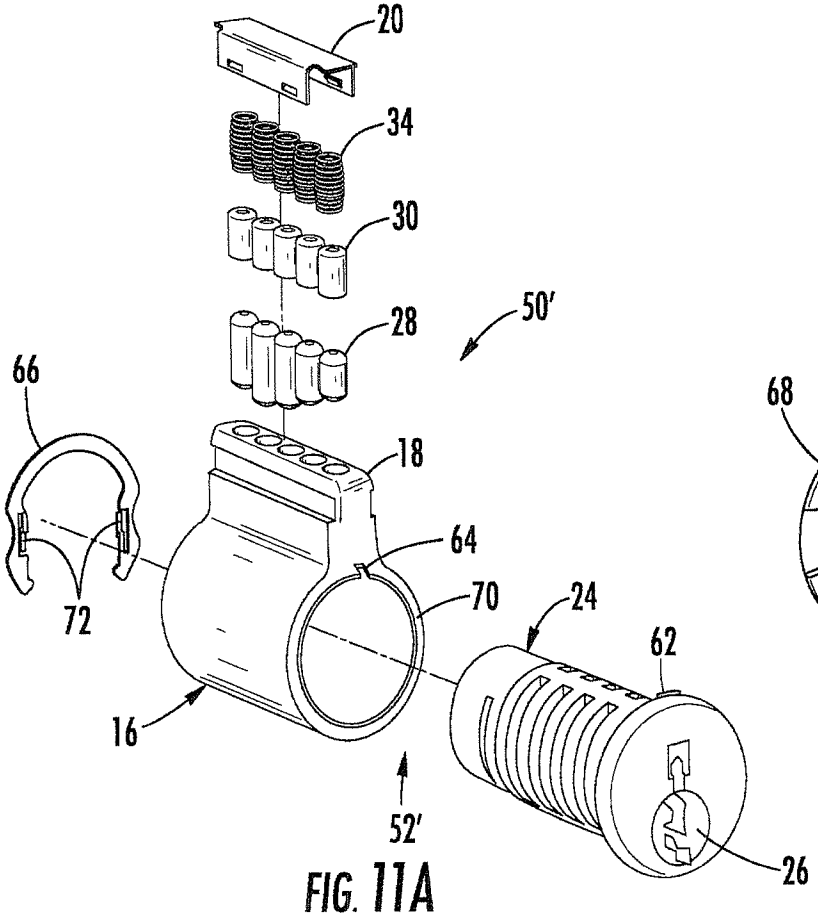
Figure 12:
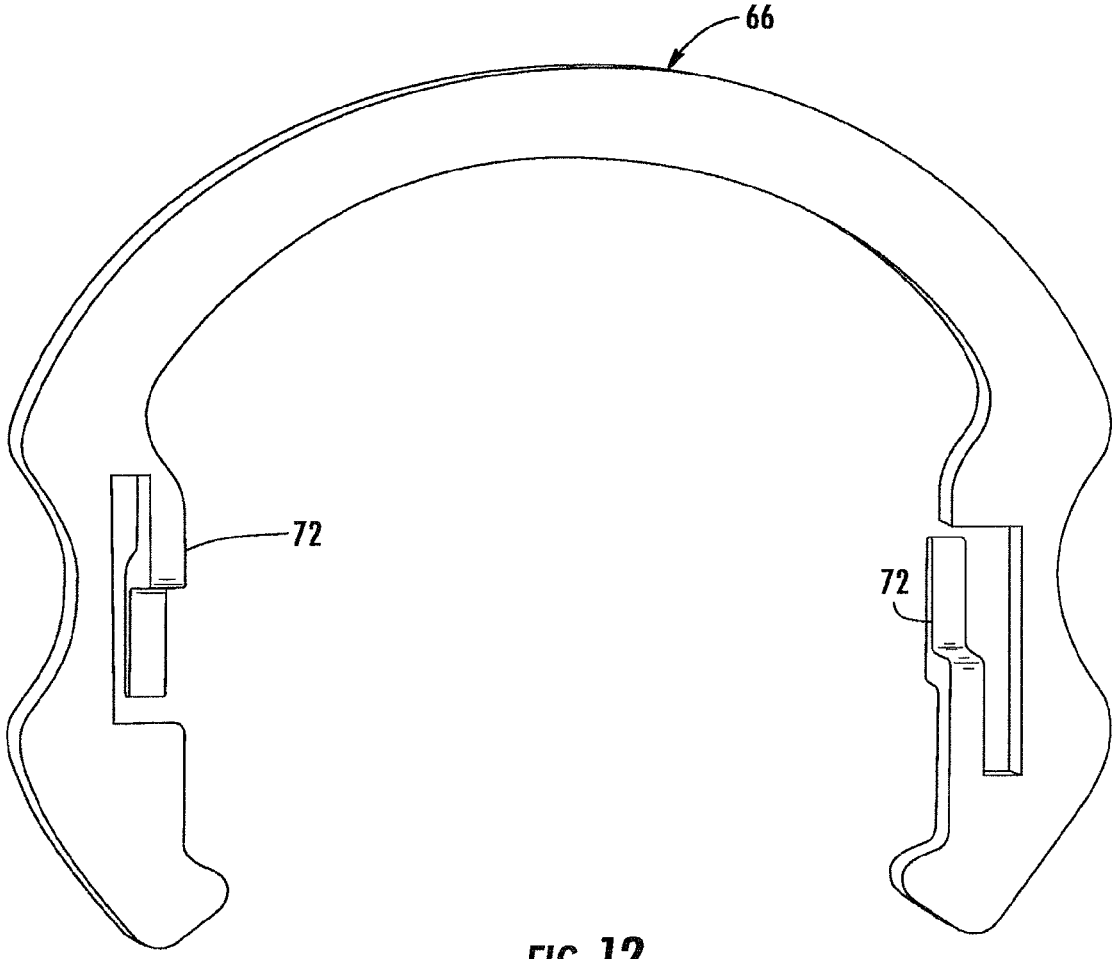
FIG. 12 is an enlarged perspective detail view of the compression spring retaining clip of the pick-resistant lock cylinder of FIGS. 11A and 11B.

Referring to FIGS. 11A, 11B and 12, another embodiment 50' of a pick-resistant lock cylinder according to the present invention is shown. In this embodiment, a torque augmentor 52' includes a cam follower 62 normally biased into engagement with a cam 64 by a compression spring retaining clip 66. Cam follower 62 is a protrusion axially extending towards the cylinder body 16 and formed on end surface 68 of plug body 24. The cam 64 has a mating cross-section extending axially into cylinder body end surface 70. As shown in FIG. 12, compression spring retaining clip 66 defines a set of oppositely-extending spring features 72, with one extending axially forwardly, and the other extending axially rearwardly. The compression spring retaining clip 66 show in this embodiment of the present invention serves its usual purpose, namely, to retain the plug assembly 22 in the cylinder assembly 14, but it also normally spring-biases the cam follower 62 into engagement with the cam 64, so that a predetermined augmented torque can be achieved. That torque can be varied by varying the configurations and properties of the compression spring retaining clip 66, cam follower 62 and cam 64, and can be selected to lie in the optimum range of 6 to 18 inch-ounce force, if desired. Also, cam follower 62 may be located on the cylinder body end surface 70, and cam 64 may be located on plug body end surface 68, if desired.

Figure 13:
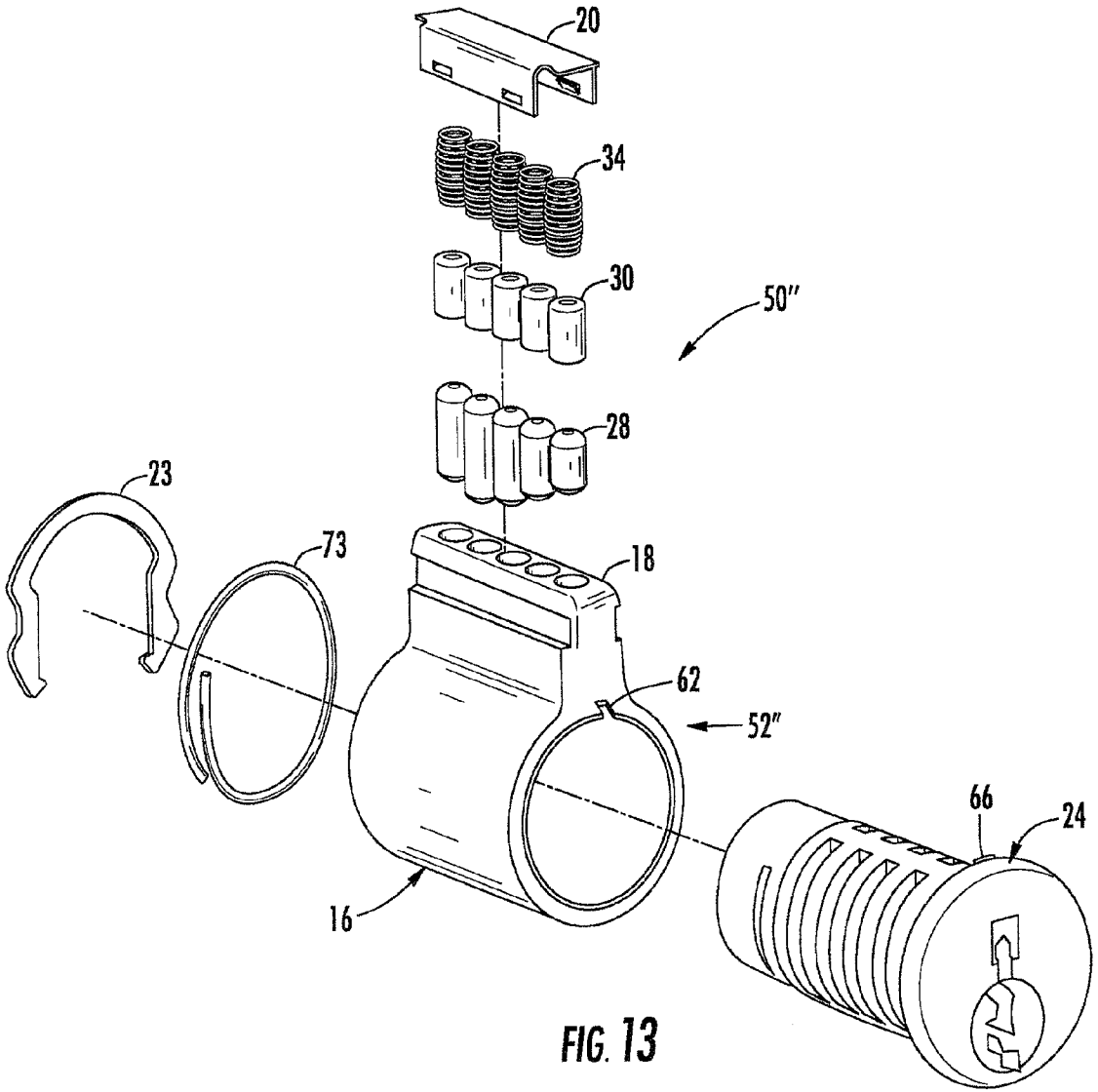
FIG. 13 is a partial exploded perspective view of yet another embodiment of a pick-resistant lock cylinder of the present invention.

On the other hand, if it is desired to use the more conventional retaining clip 23, as shown in FIGS. 1 and 13, then yet another embodiment 50" of the pick-resistant lock cylinder of the present invention can be implemented. Here, a torque augmentor 52" includes a compression spring 73, which provide the bias for normally urging the cam follower 62 into engagement with cam 64. Again, the configurations and other properties of the compression spring 73, cam follower 62 and cam 64 can be varied to yield the desired augmented torque.

Figure 17:
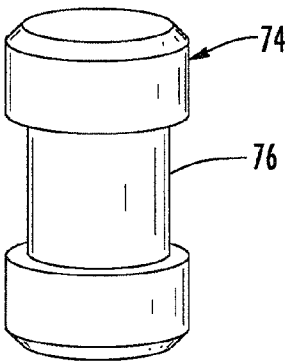
FIG. 17 Prior Art
FIG. 17 is a perspective detail view of a conventional cylinder pin for creating a false shear line.

One of the conventional ways to attempt to thwart attacks upon pin tumbler lock cylinders has been to use one or more cylinder pins having reduced diameters, as shown at 74 in FIG. 17. These pins 74 are used to create "false shear lines," in that, after a set has been achieved with four of the five cylinder pins, for example, the attacker may feel the plug assembly 22 rotate within the cylinder assembly 14, as if a set has been achieved with the fifth and final pin. However, what has actually happened is that a cylindrical reduced-diameter portion 76 of the cylinder pin 74 has straddled the shear line 32, thereby enabling the pin to tilt a little in response to the attacker's applied torque. The tilt allows the plug assembly 22 to rotate, but then it stops, trapping the pin 74, and causing the attacker to lose set and start all over again.

Figure 14:
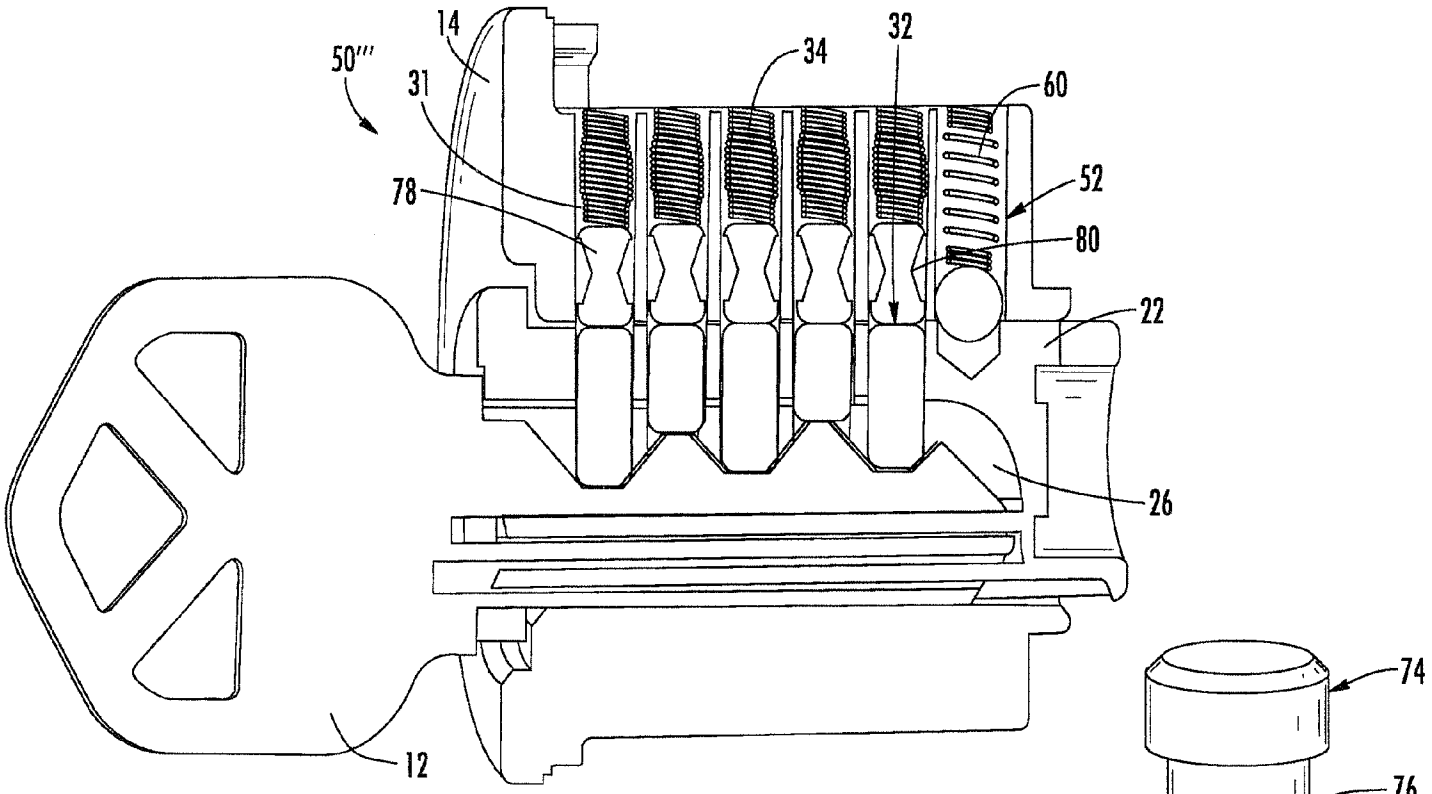
FIG. 14 is a side elevational detail view, partially in section, of still another embodiment of a pick-resistant lock cylinder of the present invention, equipped with false shear line creators of the present invention.
Figure 15:
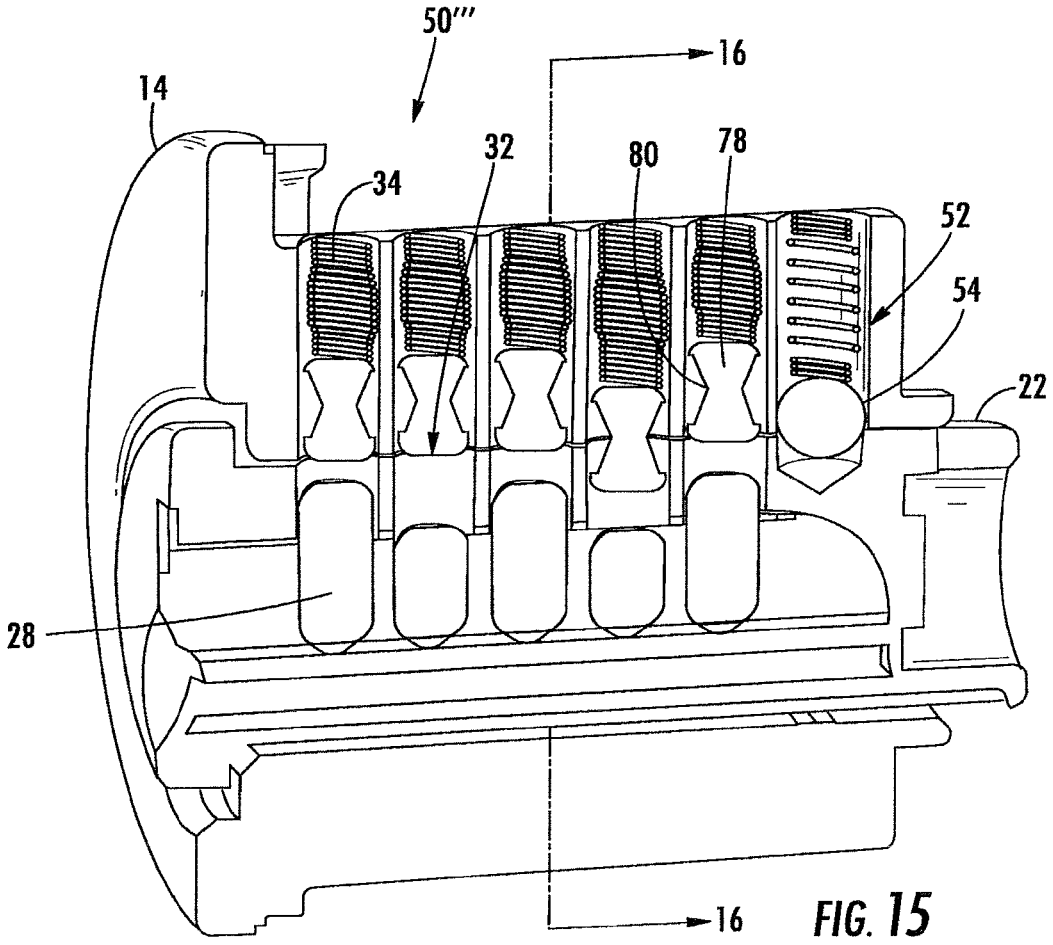
FIG. 15 is an enlarged side elevational view of the pick-resistant lock cylinder of FIG. 10 showing a false shear line creator straddling the shear line while all of the other cylinder pins have been set.
Figure 16:
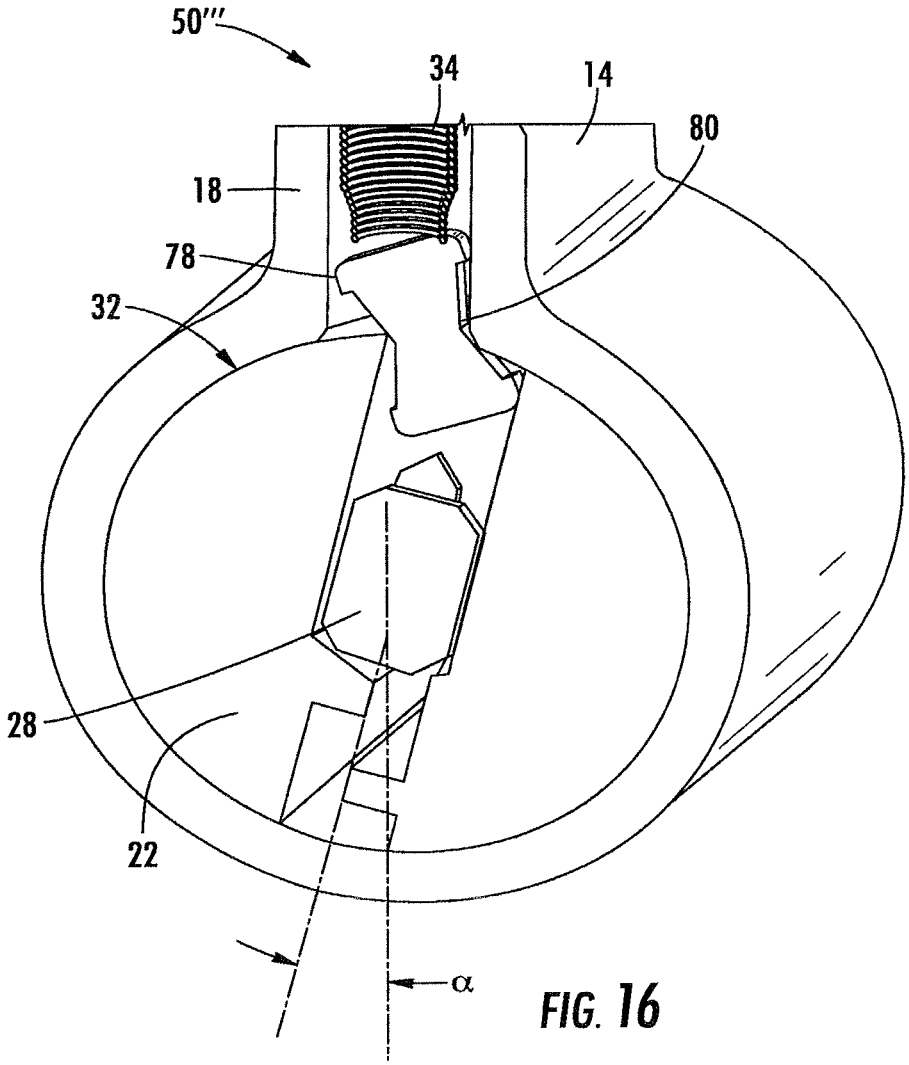
FIG. 16 is an enlarged partial sectional detail view, taken along line 16-16 of FIG. 15, after having fooled an attacker into incrementally rotating the plug assembly in the cylinder assembly.

However, up until now, the double-cylinder configurations of the cylinder pins 74 of FIG. 17 have not been entirely satisfactory in foiling picking and bumping attacks. On the other hand, it has been discovered that using false shear line creators in conjunction with the torque augmentors 52, 52' and 52" of the pick-resistant lock cylinders 50, 50' and 50" of the present invention enhances the effectiveness of both the torque augmentors and of the false shear line creators. False shear line creators 78 of the present invention, as shown in FIGS. 14, 15 and 16, have been particularly effective. These are cylinder pins having hourglass cross-sections, which yield significantly narrower reduced-diameter portions 80, than the double-cylinder pin 74 of FIG. 17. Although the false shear line creators 78 are shown in use with the torque augmentor 52, they can also be used with torque augmentors 52' and 52" of the pick-resistant lock cylinders 50' and 50".

Accordingly another embodiment 50" of the pick-resistant lock cylinder of the present invention is shown in FIGS. 14, 15 and 16, in which the elements of the rest of the lock cylinder 50" are the same as those of lock cylinder 50 shown in FIG. 10, except for the cylinder pins 30, which have been replaced by the hourglass-shaped false shear line creators 78 of the present invention. Although FIG. 14 shows that all of the cylinder pins 30 have been replaced by false shear line creators 78, fewer can be used if desired.

Now referring to FIGS. 15 and 16, the attacker has been fooled into believing that, having achieved a set for four of the pins 78, he's gotten a set for the fifth one, as well, because as shown in FIG. 16, the plug assembly 22 has rotated by an angle a within the cylinder assembly 14. And here's where the hourglass shape of the false shear line creator of the present invention excels over the conventional double cylinder shape 74 of FIG. 17. Whereas in lock cylinders using the cylinder pins 74 of FIG. 17, attackers could feel some rotation of the plug assembly within the cylinder assembly, the amount of rotation was limited by the relatively large diameter 76, and the attackers could sense the presence of the false shear line and recover without losing their set. In the pick-resistant lock cylinder 50'" of the present invention, however, the hourglass shape of false shear line creator 78 yields such a small reduced-diameter portion 80 that the plug assembly 22 can rotate a full 12° in some embodiments. This "crushes" the false shear line creator 78 between the cylinder assembly 14 and the plug assembly 22, and the attacker is stuck. Now the plug assembly 22 has rotated too far for the attacker to be able to achieve a set on the last pin, the torque augmentor 52, 52' and 52" having caused the attacker to lose the set when the applied torque is reduced to release the crushed false shear line creator 78. But even before the "crush" point, the coaction of the false shear line creator 78 with the torque augmentors 52, 52' and 52" will likely cause the attacker to feel the false shear line creator resist the pressure of the attacker's pick 38. The attacker will then back off the applied torque somewhat, but the augmented torque resistance will cause the system to reset to the home position and the attacker will have to start all over again.

However, the coaction of the false shear line creator 78 and torque augmentors 52, 52' and 52" also stabilize the false shear line creators enough so that they do not jam the mechanism when a valid key is used to unlock the cylinder. Furthermore, if the configurations of the tips of the torque augmentors are varied, along with the configurations of the false shear line creators, then a daunting set of permutations and combinations of variables can be presented to an attacker. In such an arrangement, the torque feedback sensed by the attacker will be dependent upon the shape of the torque augmentor tip AND how far the plug has rotated AND the shape of the cylinder pin.

Furthermore, the coaction of false shear line creator 78 and torque augmentors 52, 52' and 52" of the pick-resistant lock cylinders 50, 50' and 50" also provide enhanced protection against bumping attacks. Referring to FIGS. 9B, 9C and 16, to overcome the augmented torque resistance, the attacker is tempted to apply too much torque to the plug assembly. Then when the attacker hits the plug assembly, the false shear line creators 78 separate from the key followers 28, but at least one false shear line creator is likely to become skewed and get crushed, as shown in FIG. 16. Once again, the attacker is stuck.

In some embodiments, the present invention contemplates using hourglass-shaped false shear line creators 78, but it can be appreciated that other shapes that yield sufficiently small reduced-diameter portions are contemplated within the scope of the present invention as well.

Moreover, the above-described embodiments are not to be construed as limiting the breadth of the present invention. Modifications and other alternative constructions will be apparent that are within the spirit and scope of the invention as defined in the appended claims.

What is claimed:

1. A pick-resistant pin tumbler lock cylinder, comprising:

a cylinder assembly;

a plug assembly rotatably disposed in the cylinder assembly and defining a longitudinally-extending plug axis, wherein the plug assembly includes a first end with a keyway and an opposing second end, wherein the first end of the plug assembly includes an end surface extending approximately transversely from the plug axis;

a plurality of key followers moveably disposed in a predetermined array in the plug assembly and transverse to the plug axis;

a plurality of cylinder pins moveably disposed in the cylinder assembly and being operatively associated with the key followers;

the cylinder pins being normally biased into engagement with corresponding key followers so that at least one of the cylinder pins is disposed across a shear line defined by the intersection of the plug assembly with the cylinder assembly thereby preventing rotation of the plug assembly in the cylinder assembly;

said at least one of the cylinder pins being moved above the shear line upon insertion of a valid key in the keyway thereby permitting rotation of the plug assembly in the cylinder assembly; wherein an attacker being able to insert a first tool into the keyway to apply a threshold rotational torque to the plug assembly, and further being able to insert a second tool into the keyway to sense the relationship of said at least one cylinder pin to the shear line during application of the threshold torque; and further comprising:

a torque augmenter operatively associated with the cylinder assembly and the plug assembly to increase the threshold torque required to rotate the plug assembly in the cylinder assembly thereby hampering the attacker's ability to sense the relationship of said at least one cylinder pin to the shear line by manipulating said first and second tools; and wherein the torque augmentor includes one of a cam and a cam follower disposed on the cylinder assembly and being normally biased into engagement with the other of said cam and cam follower disposed on the end surface of the plug assembly.

2. The lock cylinder claimed in claim 1, further comprising a compression spring retaining clip operatively associated with the second end of the plug assembly and the cylinder assembly to provide the bias.

3. The lock cylinder claimed in claim 2, wherein the compression spring retaining clip defines two oppositely-directed spring features.

4. The lock cylinder claimed in claim 1, further comprising:

a retaining clip operatively associated with the second end of the plug assembly and the cylinder assembly; and a compression spring disposed between the retaining clip and the cylinder assembly.

5. The lock cylinder claimed in claim 1, further comprising:

a false shear line creator operatively associated with the cylinder assembly and the plug assembly.

6. The lock cylinder claimed in claim 5, wherein the false shear line creator includes a cylinder pin having a false shear line portion such that when the attacker manipulates the second tool to move said at least one cylinder pin to a position in which the false shear line portion straddles the actual shear line, the attacker mistakenly senses a shear line.

7. The lock cylinder claimed in claim 6, wherein the cylinder pin false shear line portion being defined by a reduced-diameter portion.

8. The lock cylinder claimed in claim 7, wherein the cylinder pin having an hourglass configuration.

9. The lock cylinder claimed in claim 8, wherein when the cylinder pin straddles the shear line, the attacker can rotate the plug assembly at least approximately 12 degrees relative to the cylinder assembly.

10. The lock cylinder claimed in claim 5, wherein the coaction of the torque augmentor and the false shear line creator also hampers an attack against the lock cylinder by bumping.

11. The lock cylinder claimed in claim 9, wherein the coaction of the torque augmentor and the false shear line creator also hampers an attack against the lock cylinder by bumping.

12. The lock cylinder claimed in claim 1, wherein the biasing of the cam with respect to the cam follower is along the plug axis.

* * * * *